US006481583B1

(12) United States Patent
Black et al.

(10) Patent No.: US 6,481,583 B1
(45) Date of Patent: Nov. 19, 2002

(54) TOOL HOLDER SYSTEM

(75) Inventors: Charles D. Black, Williston, ND (US); Wesley F. Black, Williston, ND (US)

(73) Assignee: Stringliner Company, Williston, MD (US)

( * ) Notice: Subject to any disclaimer, the term of this patent is extended or adjusted under 35 U.S.C. 154(b) by 0 days.

(21) Appl. No.: 09/593,179

(22) Filed: Jun. 13, 2000

(51) Int. Cl.[7] ..... A47F 7/00

(52) U.S. Cl. ..... 211/70.6; 211/89.01; 248/221.2

(58) Field of Search ..... 211/70.6, 70.2, 211/70.7, 70.8, 87.01, 89.01, 60.1, 68; 248/220.21, 220.31, 220.41, 220.42, 220.43, 222.11, 222.12, 222.51, 225.21, 220.22; 206/349, 372, 376, 477–482

(56) References Cited

U.S. PATENT DOCUMENTS 2,312,985 A * 3/1943 Bales ..... 248/222.51
3,927,765 A * 12/1975 Beal ..... 206/481
4,290,575 A * 9/1981 Swartwout ..... 248/316
4,405,110 A * 9/1983 Gibbons ..... 248/221.2
4,410,095 A * 10/1983 Dembicks ..... 211/60.1
4,619,428 A * 10/1986 Bailey ..... 248/221.2
4,723,663 A * 2/1988 Learn ..... 211/59.2
4,898,354 A * 2/1990 Whittington et al. .... 248/225.1
4,917,337 A * 4/1990 Gridley ..... 248/221.2
4,941,577 A * 7/1990 Ferree et al. ..... 211/70.6
5,224,609 A * 7/1993 Bauer et al. ..... 211/65
5,501,330 A * 3/1996 Betts ..... 206/349
5,503,277 A * 4/1996 O'Brien ..... 211/94.01
5,505,316 A * 4/1996 Lee ..... 211/70.6
5,507,545 A * 4/1996 Krysiak ..... 248/304
5,681,539 A * 10/1997 Riley ..... 206/370
5,713,467 A * 2/1998 Kao ..... 206/349
5,743,416 A * 4/1998 Yemini ..... 211/70.6
5,788,303 A * 8/1998 Chia-Hsiang ..... 211/70.6
5,855,274 A * 1/1999 Piao ..... 206/373
5,967,340 A * 10/1999 Kao ..... 211/70.6
5,979,675 A * 11/1999 Moriarty ..... 211/70.6
5,988,408 A * 11/1999 Evans et al. ..... 211/70.6
5,996,817 A * 12/1999 Kao ..... 211/70.6
6,126,004 A * 10/2000 Ling ..... 206/377
6,202,865 B1 * 3/2001 Kuo ..... 211/70.6
6,244,447 B1 * 6/2001 Frieze et al. ..... 211/70.6
6,283,311 B1 * 9/2001 Lee ..... 211/70.6

* cited by examiner

*Primary Examiner*—Blair M. Johnson
*Assistant Examiner*—Jennifer E. Novosad
(74) *Attorney, Agent, or Firm*—Michael S. Neustel

(57) ABSTRACT

A tool holder system for conveniently supporting one or more tools upon a pegboard structure or a wall. The tool holder system includes a support structure having a plurality of receiver openings formed for receiving a tool, a plurality of recessed portions formed into a rear portion of the support structure, a plurality of fastener slots for securing the support structure to a wall, and a clip member formed to catchably engage within said recessed portions for securing the support structure to a pegboard. The clip member is comprised of a body, an upper hook and a lower hook wherein the hooks catchably engage apertures within the pegboard. The lower hook includes a lip for catchably engaging one of the apertures within the pegboard thereby preventing accidental removal of the clip member. Each clip member further includes an upper slot for receiving a portion of the support structure and a lower slot for receiving a lower cross member within the recessed portions.

18 Claims, 16 Drawing Sheets

TOOL HOLDER SYSTEM

BACKGROUND OF THE INVENTION

1. Field of the Invention

The present invention relates generally to tool holders and more specifically it relates to a tool holder system for conveniently supporting a plurality of tools upon a pegboard structure or a wall.

2. Description of the Prior Art

Tool holders have been in use for years. Hook members that are positionable within a pegboard have been utilized for years wherein the tools are attached to the hook member. Other types of tool holders are hook members and similar structures that are securable to a wall.

The main problem with conventional tool holders is that they cannot be utilized for either pegboard or walls without modifications to the tool holder. In addition, conventional tool holders typically do not provide a convenient storage mechanism for tools. Also, conventional tool holders do not provide a stable platform for retaining tools upon a pegboard thereby contributing to tools accidentally falling and sometimes becoming damaged.

Examples of patented tool holders include U.S. Pat. No. 5,881,982 to Hollingsworth et al.; U.S. Pat. No. 5,855,347 to Hollingsworth et al.; and U.S. Pat. No. 5,743,416 to Yemini which are all illustrative of such prior art.

While these devices may be suitable for the particular purpose to which they address, they are not as suitable for conveniently supporting a plurality of tools upon a pegboard structure or a wall. Conventional tool holders are simply not suitable for supporting tools upon a pegboard or a wall as taught by the present invention.

In these respects, the tool holder system according to the present invention substantially departs from the conventional concepts and designs of the prior art, and in so doing provides an apparatus primarily developed for the purpose of conveniently supporting a plurality of tools upon a pegboard structure or a wall.

SUMMARY OF THE INVENTION

In view of the foregoing disadvantages inherent in the known types of tool holders now present in the prior art, the present invention provides a new tool holder system construction wherein the same can be utilized for conveniently supporting a plurality of tools upon a pegboard structure or a wall.

The general purpose of the present invention, which will be described subsequently in greater detail, is to provide a new tool holder system that has many of the advantages of the tool holders mentioned heretofore and many novel features that result in a new tool holder system which is not anticipated, rendered obvious, suggested, or even implied by any of the prior art tool holders, either alone or in any combination thereof.

To attain this, the present invention generally comprises a support structure having a plurality of receiver openings formed for receiving a tool, a plurality of recessed portions formed into a rear portion of said support structure, a plurality of fastener slots for securing the support structure to a wall, and a clip member formed to catchably engage within said recessed portions for securing the support structure to a pegboard. The clip member is comprised of a body, an upper hook and a lower hook wherein the hooks catchably engage apertures within the pegboard. The lower hook includes a lip for catchably engaging one of the apertures within the pegboard thereby preventing accidental removal of the clip member. Each clip member further includes an upper slot for receiving a portion of the support structure and a lower slot for receiving a lower cross member within the recessed portions.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a tool holder system that will overcome the shortcomings of the prior art devices.

A second object is to provide a tool holder system for conveniently supporting a plurality of tools upon a pegboard structure or a wall.

Another object is to provide a tool holder system that can be secured to either a wall or a pegboard structure without requiring modifications thereto.

An additional object is to provide a tool holder system that provides a stable structure for supporting tools upon a pegboard structure.

A further object is to provide a tool holder system that can be easily secured to a pegboard.

Another object is to provide a tool holder system that allows tools to be easily inserted and removed from the holder structure.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
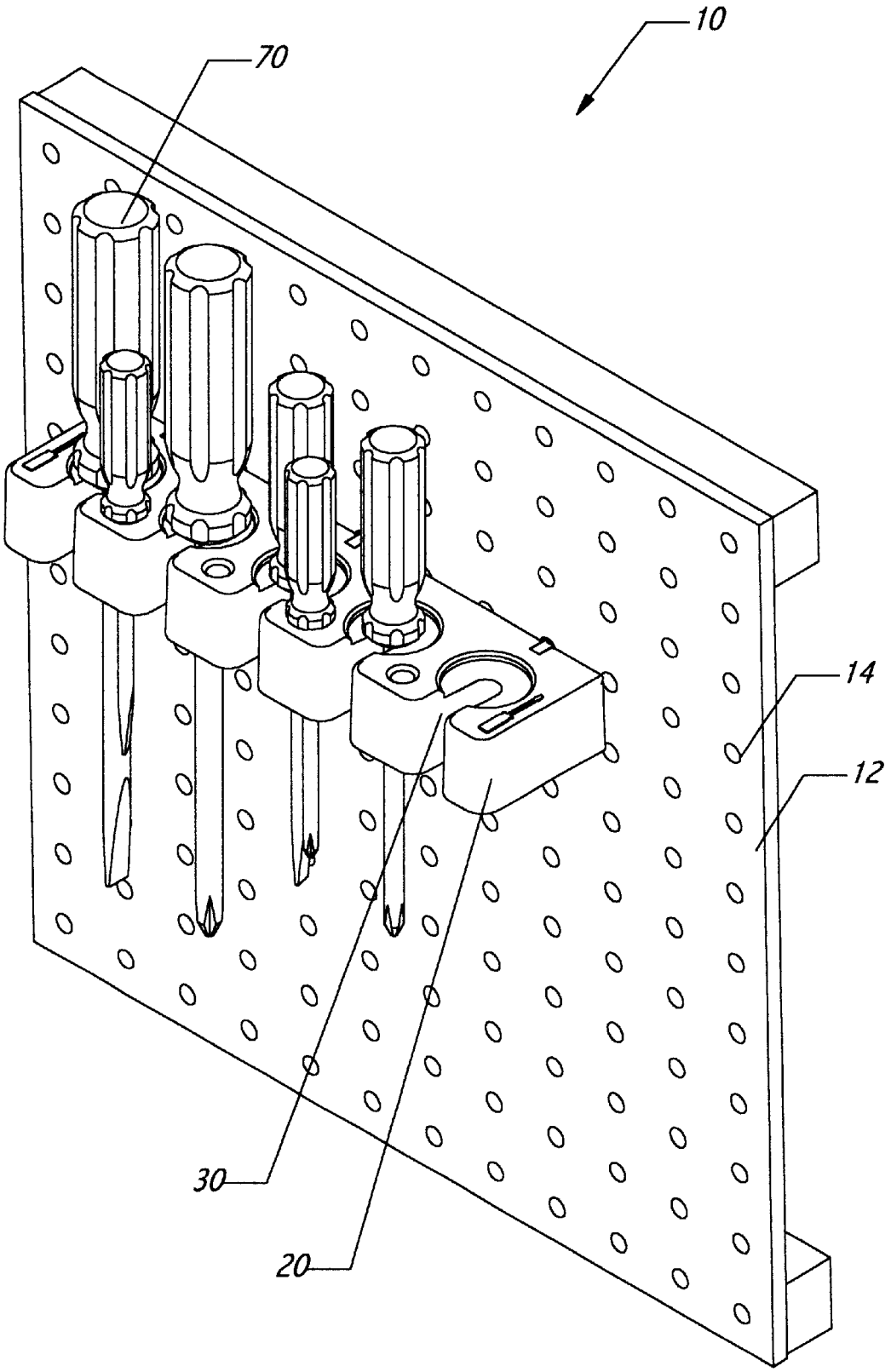
FIG. 1 is an upper perspective view of the present invention secured to a pegboard.
Figure 2:
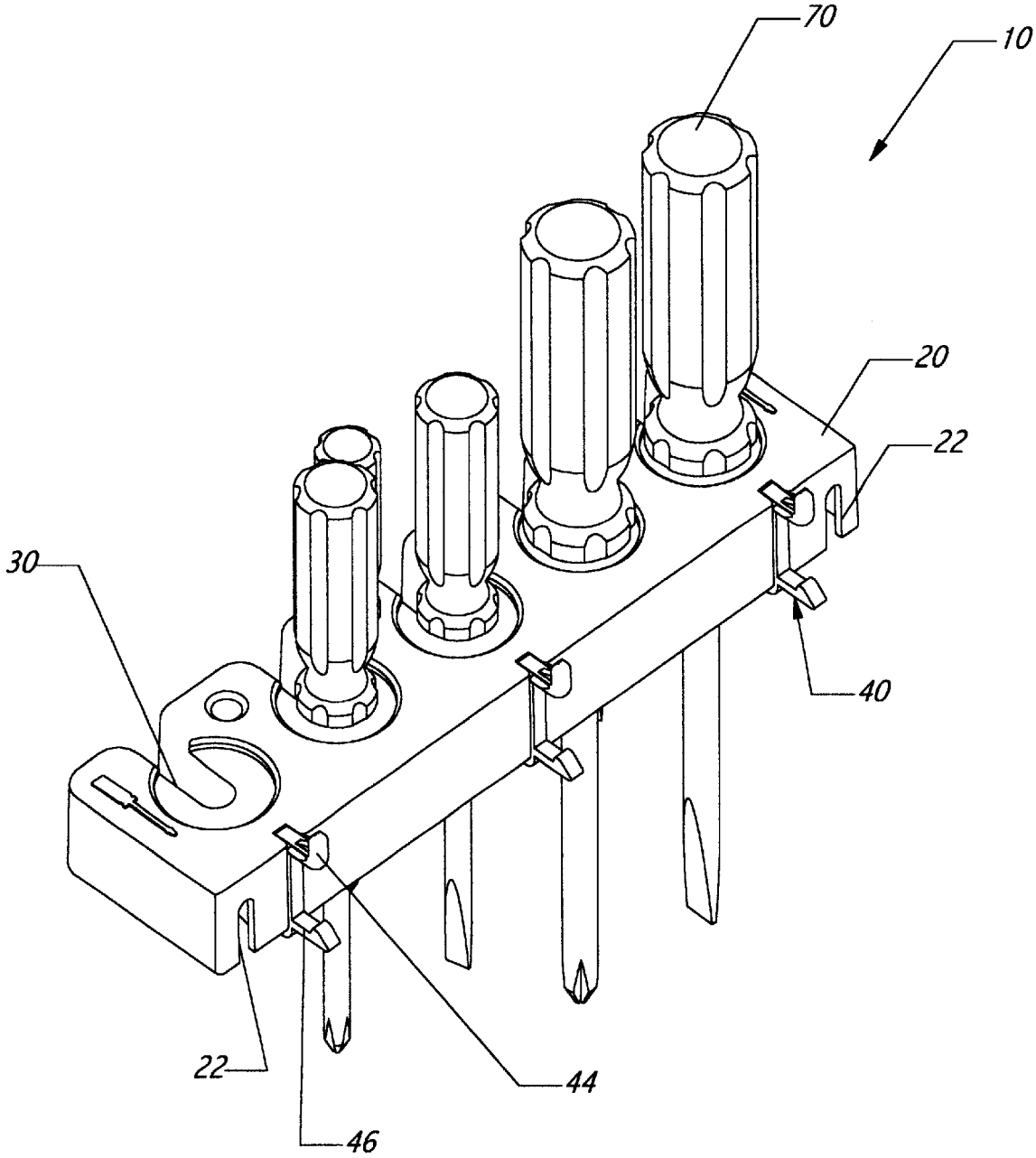
FIG. 2 is a rear upper perspective view of the present invention retaining a plurality of conventional screwdrivers.

Turning now descriptively to the drawings, in which similar reference characters denote similar elements throughout the several views, FIGS. 1 through 18 illustrate a tool holder system 10, which comprises a support structure 20 having a plurality of receiver openings 30 formed for receiving a tool, a plurality of recessed portions 24 formed into a rear portion of said support structure, a plurality of fastener slots 22 for securing the support structure 20 to a wall 16, and a clip member 40 formed to catchably engage within said recessed portions 24 for securing the support structure 20 to a pegboard 12. The clip member 40 is comprised of a body 42, an upper hook 44 and a lower hook 46 wherein the hooks catchably engage apertures 14 within the pegboard 12. The lower hook 46 includes a lip 48 for catchably engaging one of the apertures 14 within the pegboard 12 thereby preventing accidental removal of the clip member 40. Each clip member 40 further includes an upper slot 52 for receiving a portion of the support structure 20 and a lower slot 54 for receiving a lower cross member 26 within the recessed portions 24. The clip members 40 may also be formed to receive a tool such as a saw 76 by themselves.

Figure 3:
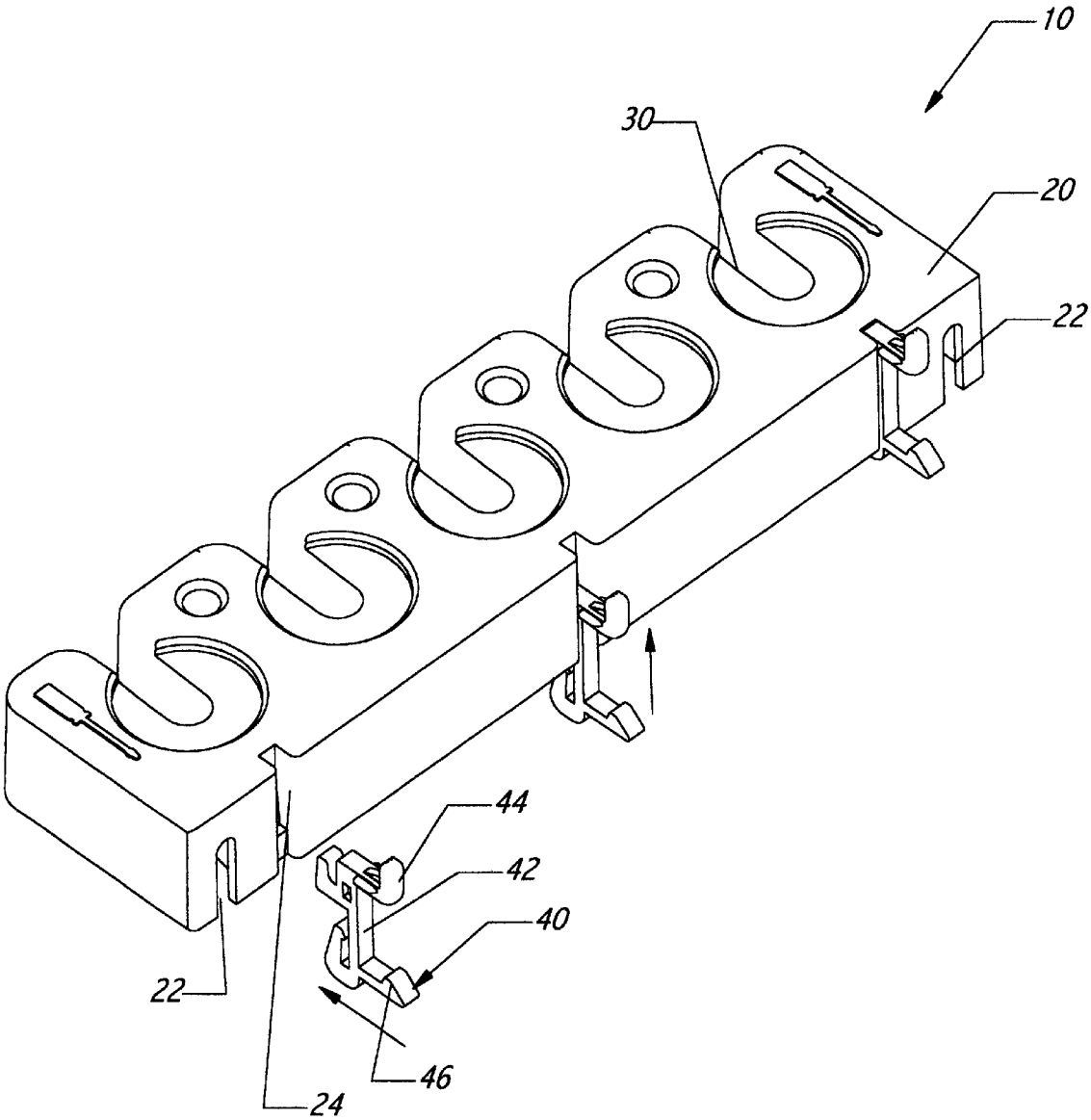
FIG. 3 is an exploded rear upper perspective view of the present invention.
Figure 4:
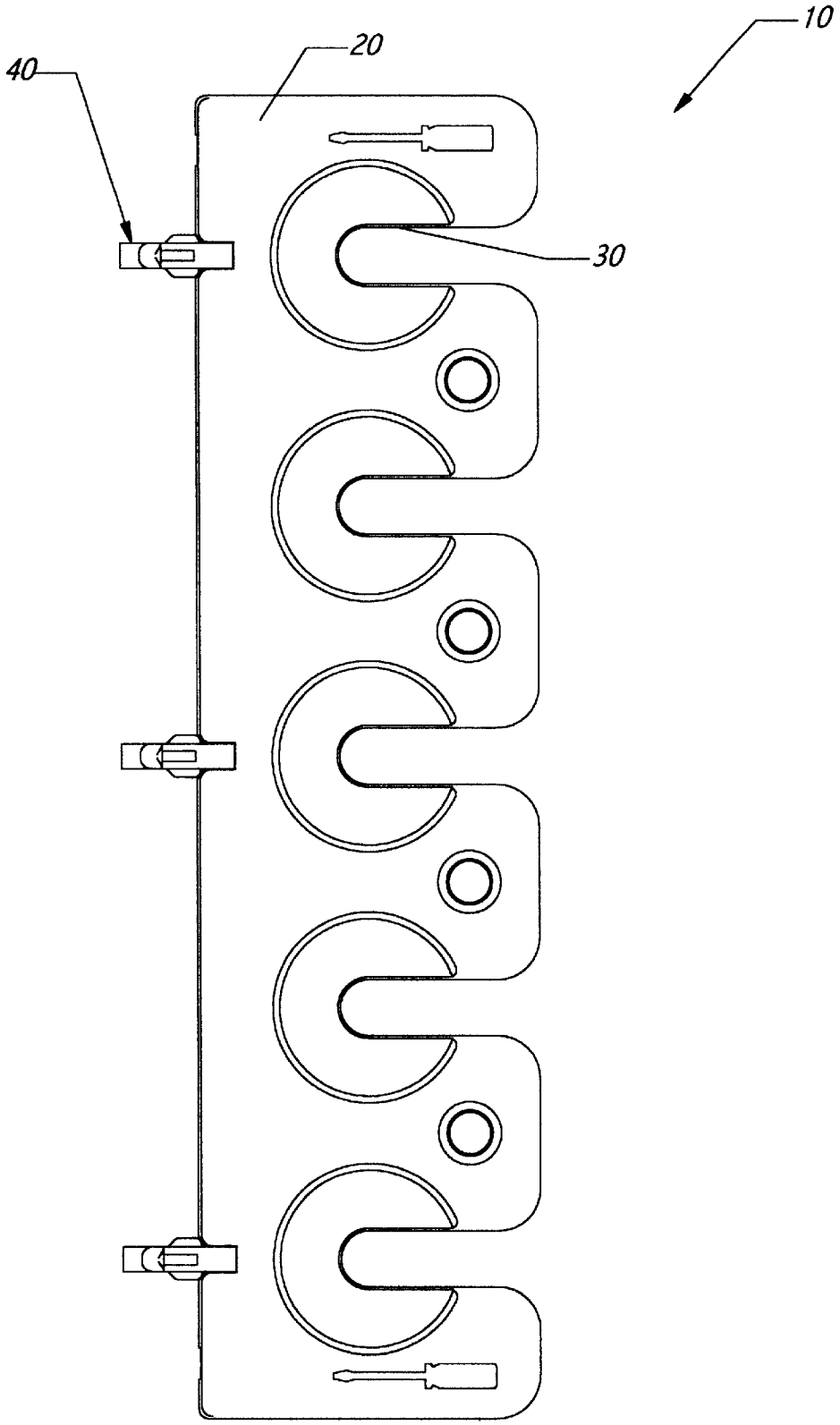
FIG. 4 is a top view of the present invention.
Figure 5:
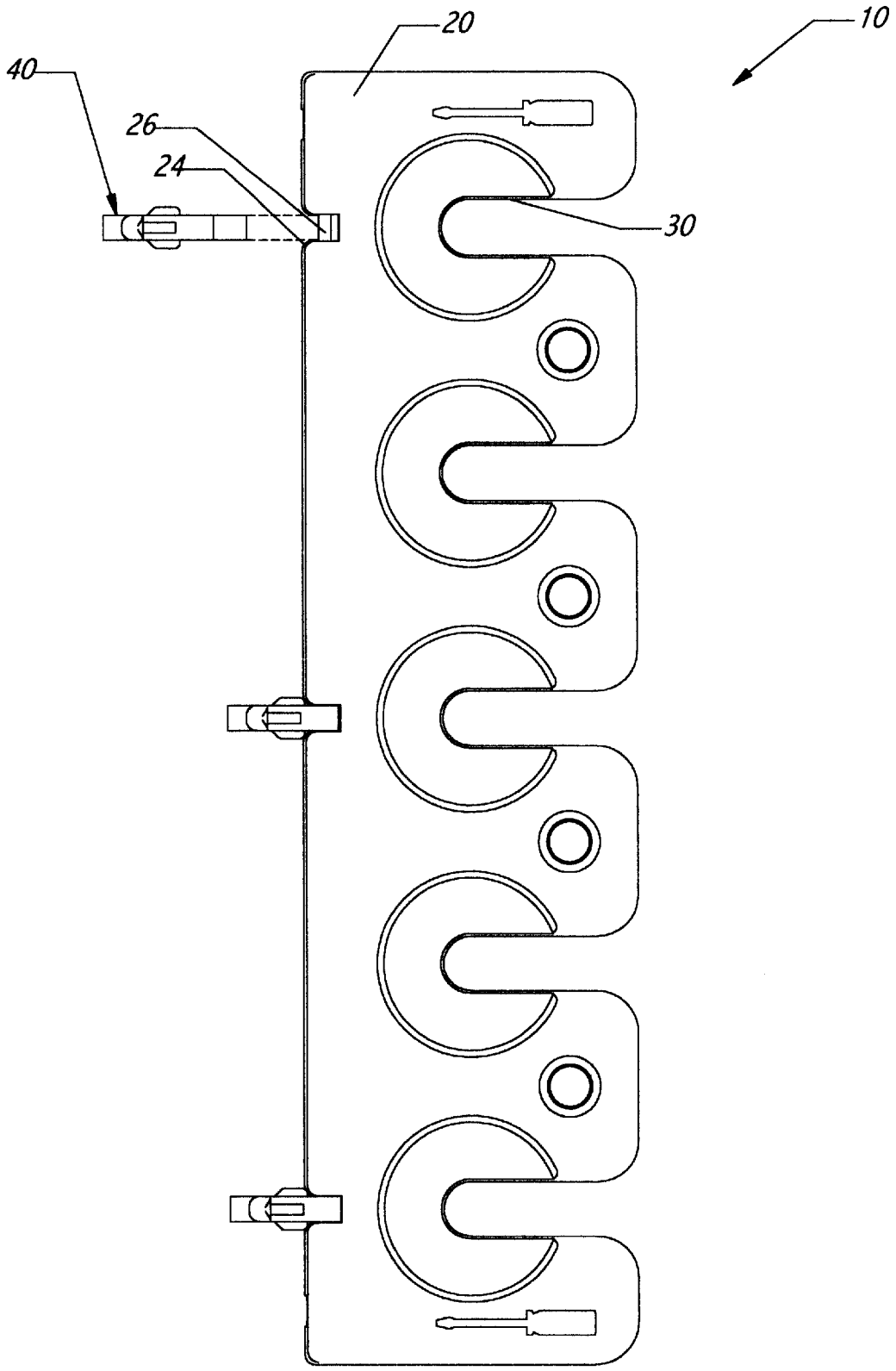
FIG. 5 is an exploded top view of the present invention.
Figure 6:
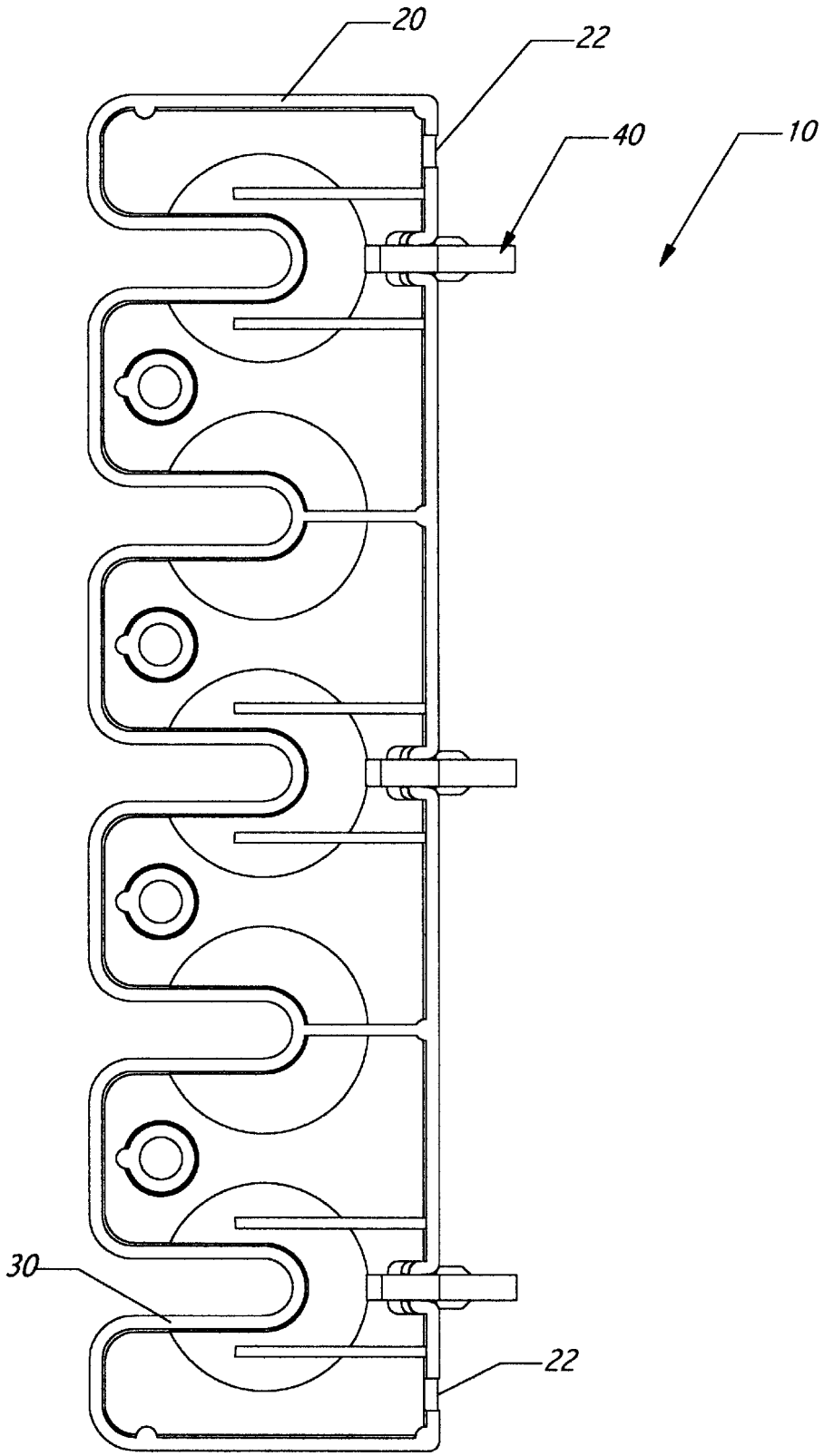
FIG. 6 is a bottom view of the present invention.
Figure 7:
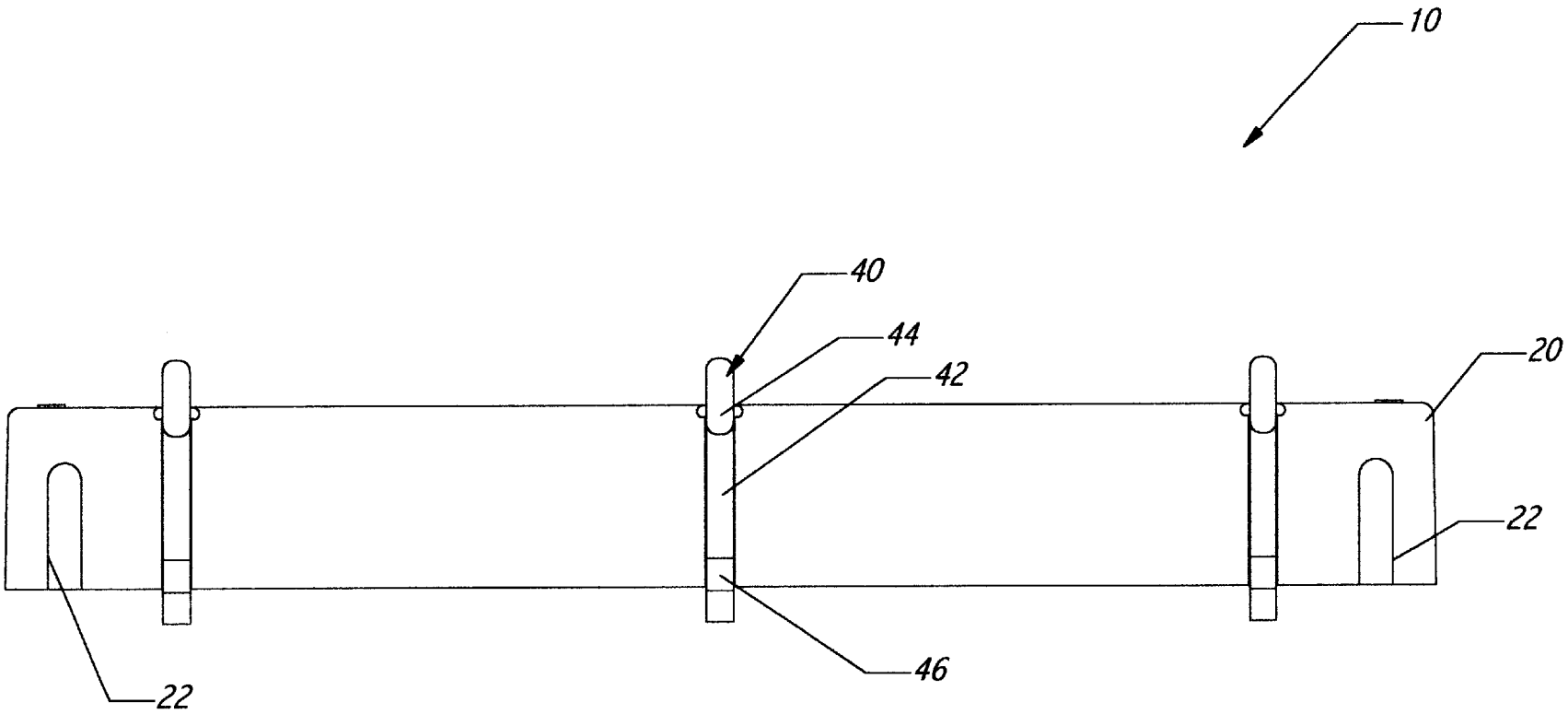
FIG. 7 is a rear view of the present invention.
Figure 8:
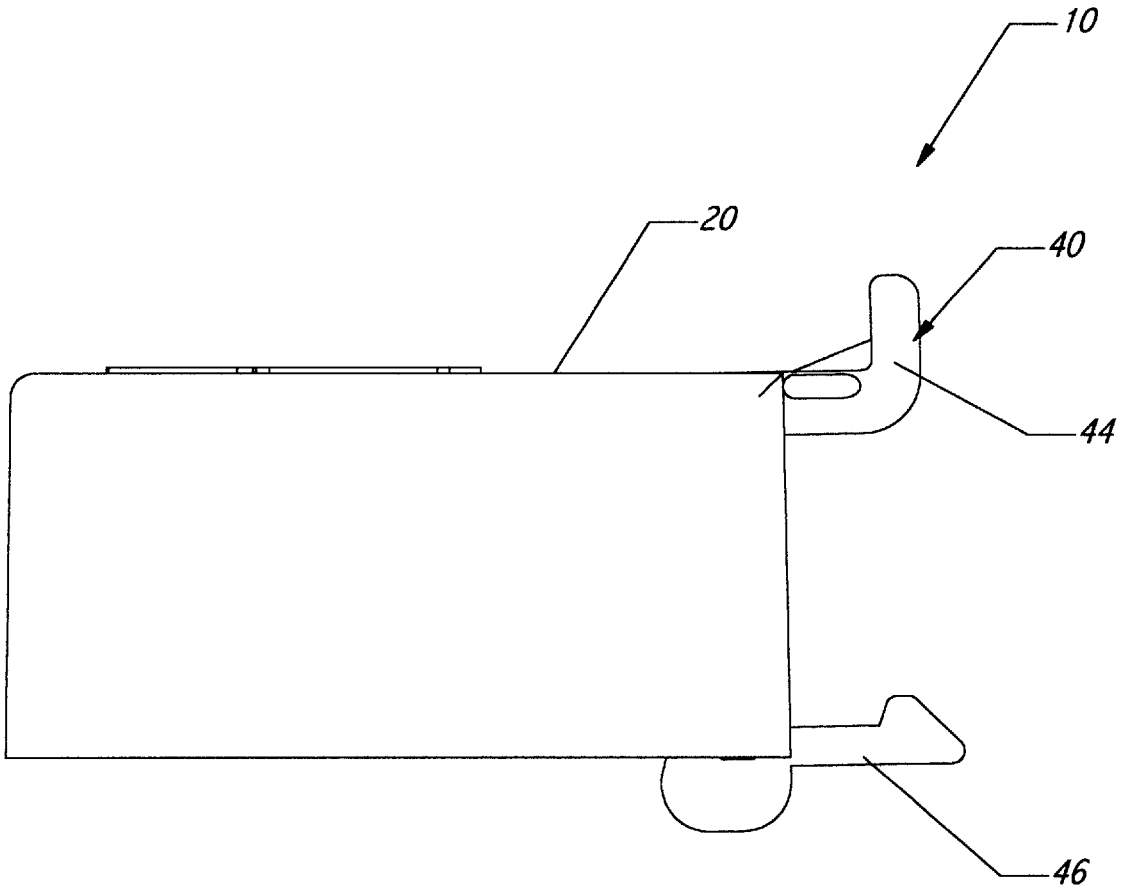
FIG. 8 is a side view of the present invention.
Figure 9:
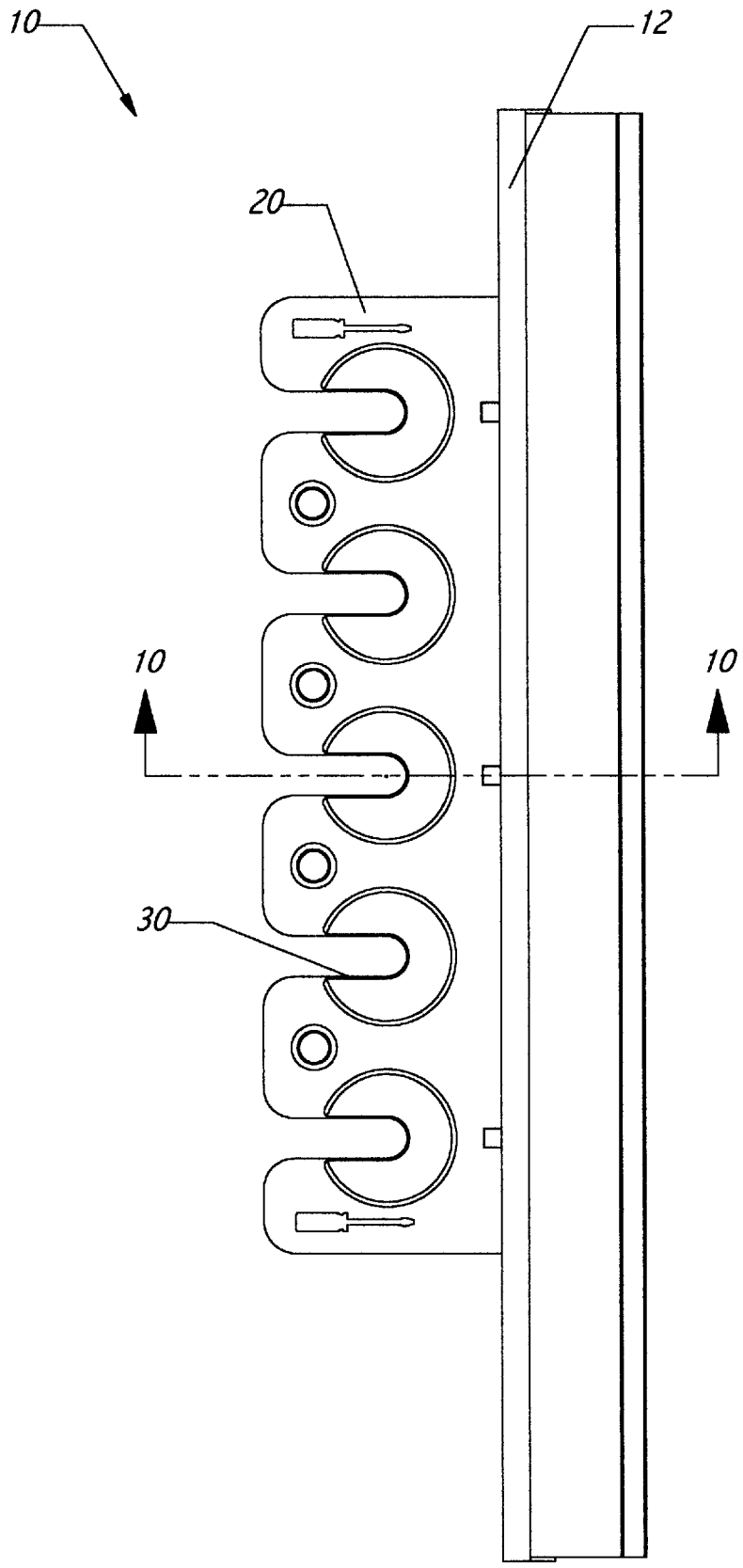
FIG. 9 is a top view of the present invention attached to a piece of pegboard.

As shown in FIGS. 1 through 12, 16, 18 of the drawings, the support structure 20 is preferably an elongated structure capable of receiving and supporting various types of tools. The support structure 20 is comprised of a top portion, a rear portion, side portions and a front portion as illustrated in FIGS. 1 and 3 of the drawings. The rear portion is preferably flat for allowing positioning adjacent a flat surface. The support structure 20 may be constructed of any well-known material such as plastic or metal. The support structure 20 is securable to either a wall 16 or a pegboard 12.

As shown in FIGS. 1, 3, 4, and 5 of the drawings, the support structure 20 includes at least one receiver opening 30 for receiving conventional tools such as screwdrivers 70, hammers 72, wrenches 74, or the like. The receiver opening 30 preferably is exposed through the front portion of the support structure 20 for allowing easy insertion and removal of the tool as shown in FIG. 1 of the drawings. However, it can be appreciated that the receiver opening 30 can be enclosed within the support structure 20 and still receive and support tools. The top portion of the support structure 20 may be formed about the receiver opening 30 to securely receive the tool positioned within the support structure 20.

Figure 16:
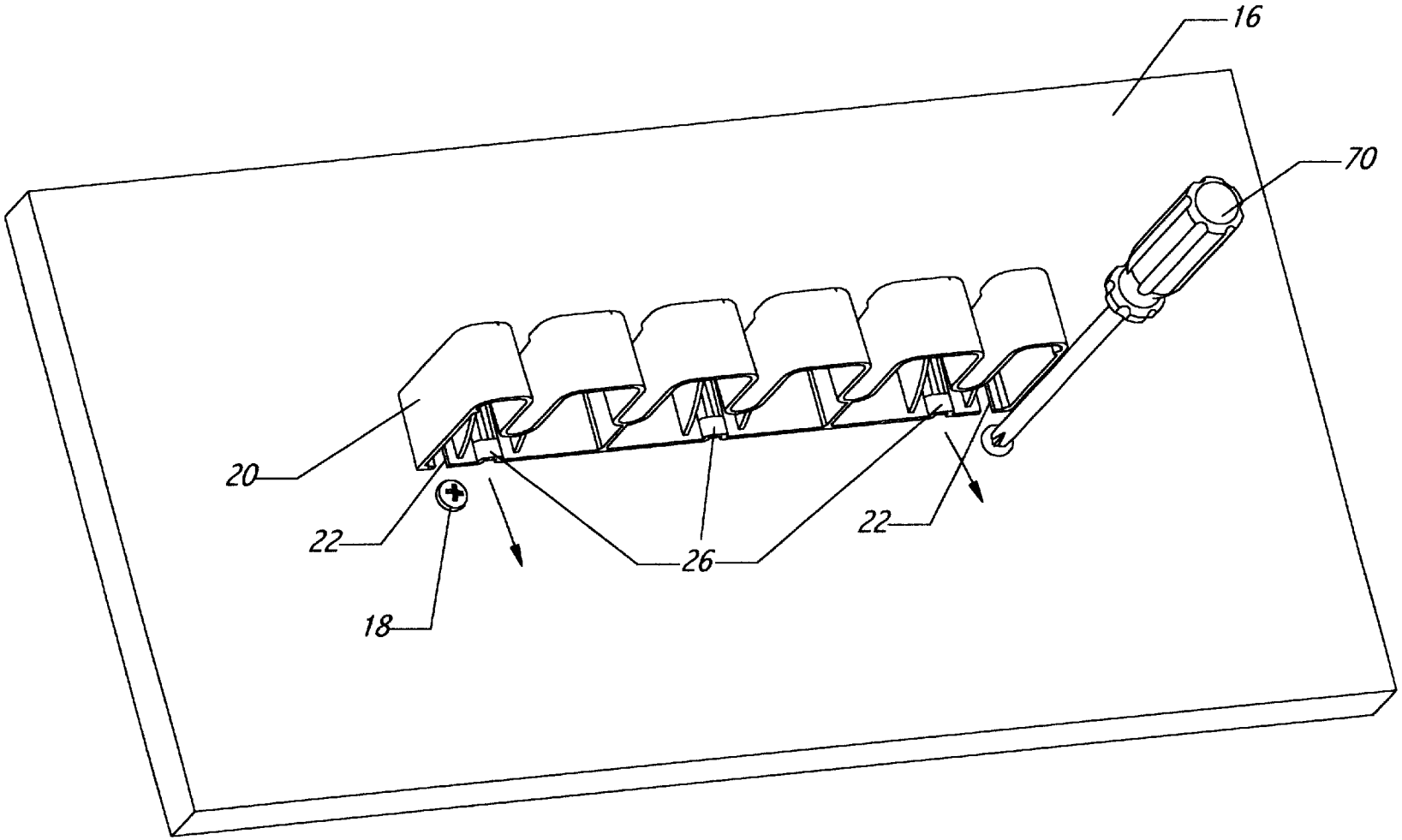
FIG. 16 is a lower perspective view of the present invention being secured to a wall fasteners being positioned within the slots.
Figure 17:
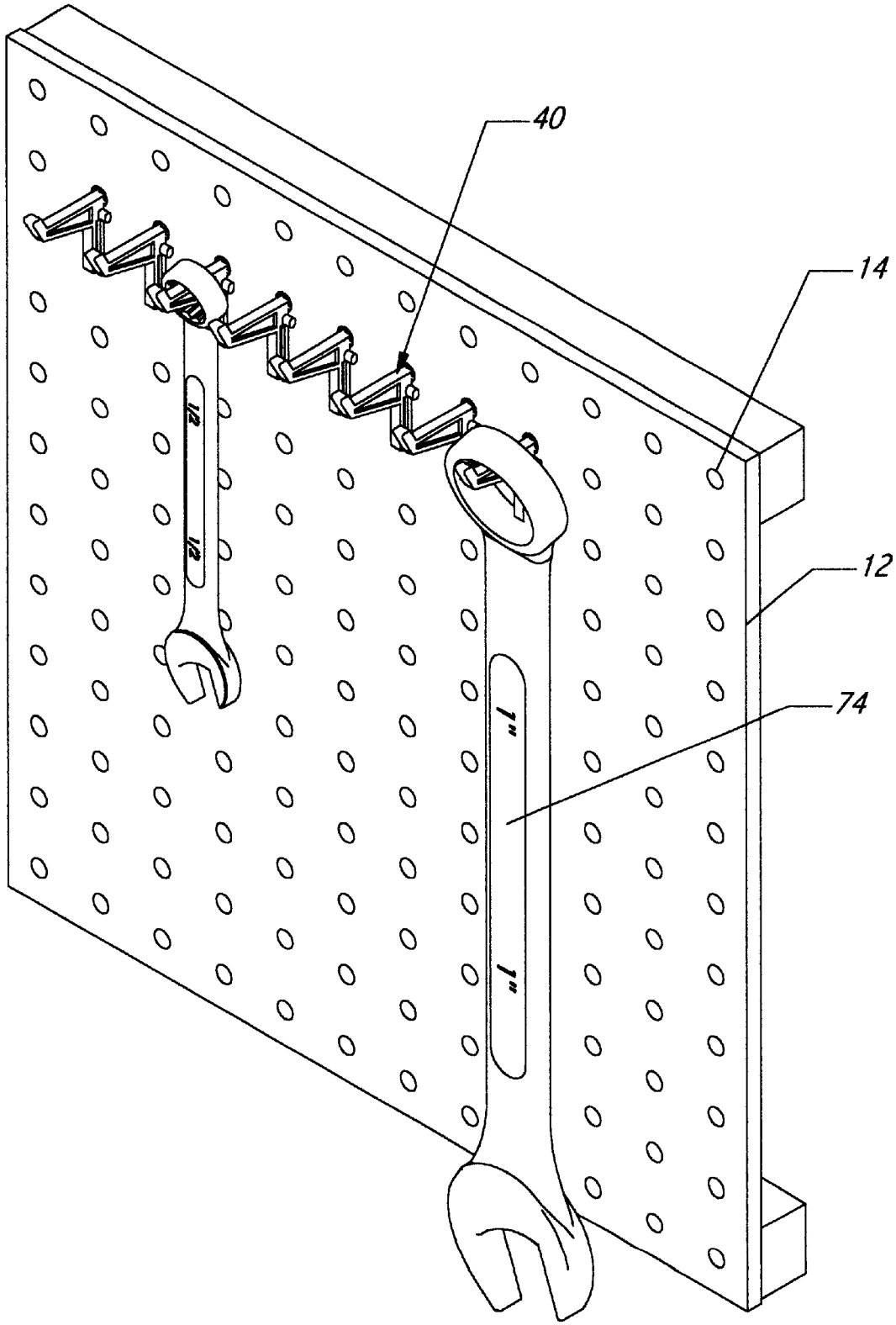
FIG. 17 is an upper perspective view of the clip member that is designed for supporting a tool independently from the support structure secured within the pegboard.
Figure 18:
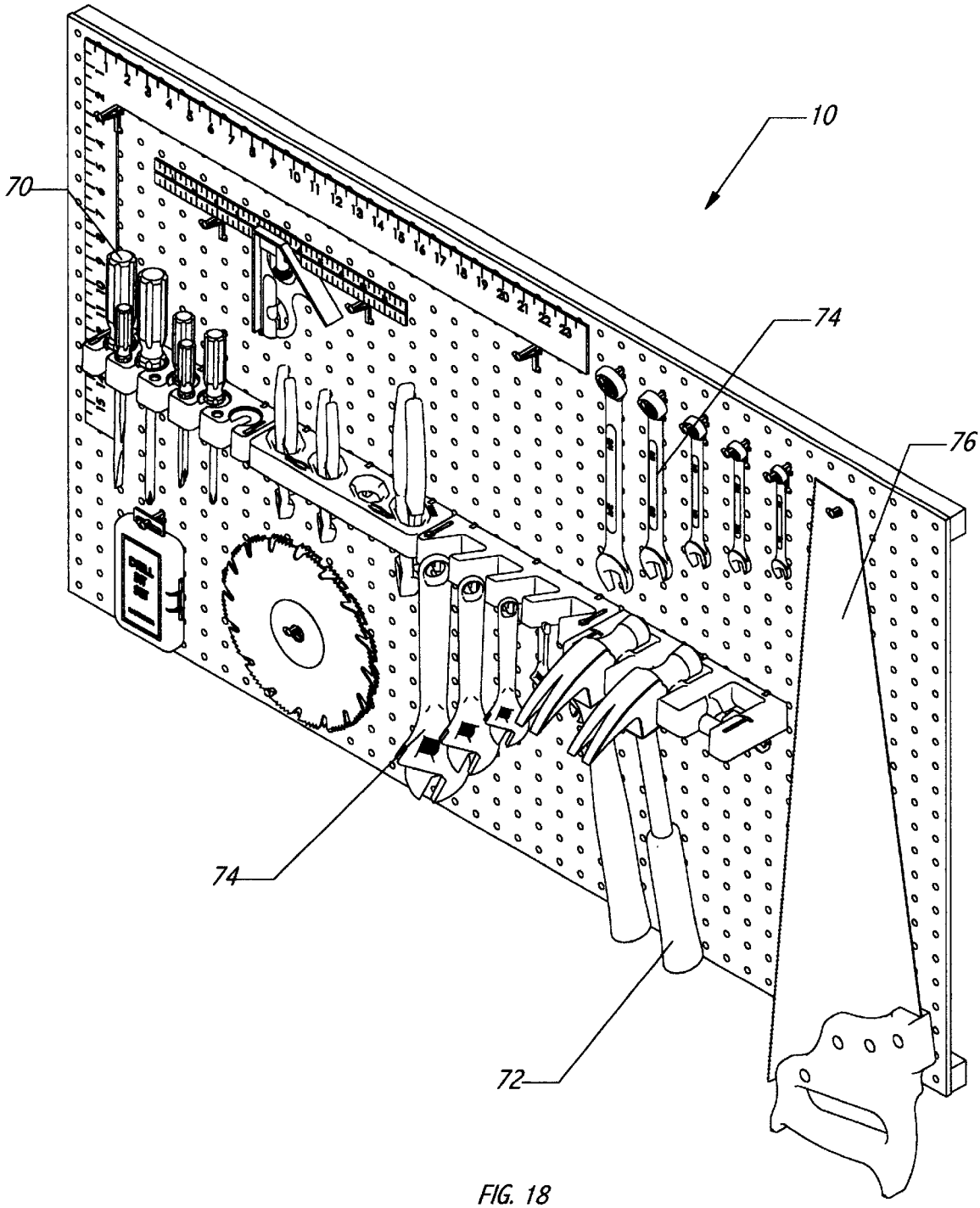
FIG. 18 is a front upper perspective view of the present invention secured to a pegboard supporting a plurality of tools.

As best shown in FIG. 3 of the drawings, the support structure 20 includes a plurality of fastener slots 22 within the rear portion for receiving a plurality of fasteners 18 thereby allowing the support structure 20 to be secured to a wall 16 or other structure. The fastener slots 22 slidably receive the fasteners 18 as best shown in FIG. 16.

A plurality of recessed portions 24 extend into the rear portion of the support structure 20 as shown in FIG. 3 of the drawings. Each of the recessed portions 24 are formed to snugly receive a clip member 40 that allows the support structure 20 to be secured to a pegboard 12 or similar structure with apertures 14 positioned within. Each of the recessed portions 24 preferably includes an aperture within wherein a portion of the clip member 40 is capable of extending into for catchably supporting the support structure 20 upon the pegboard 12. A lower cross member 26 extends across each of the recessed portions 24 for catchably receiving a clip member 40.

Figure 10:
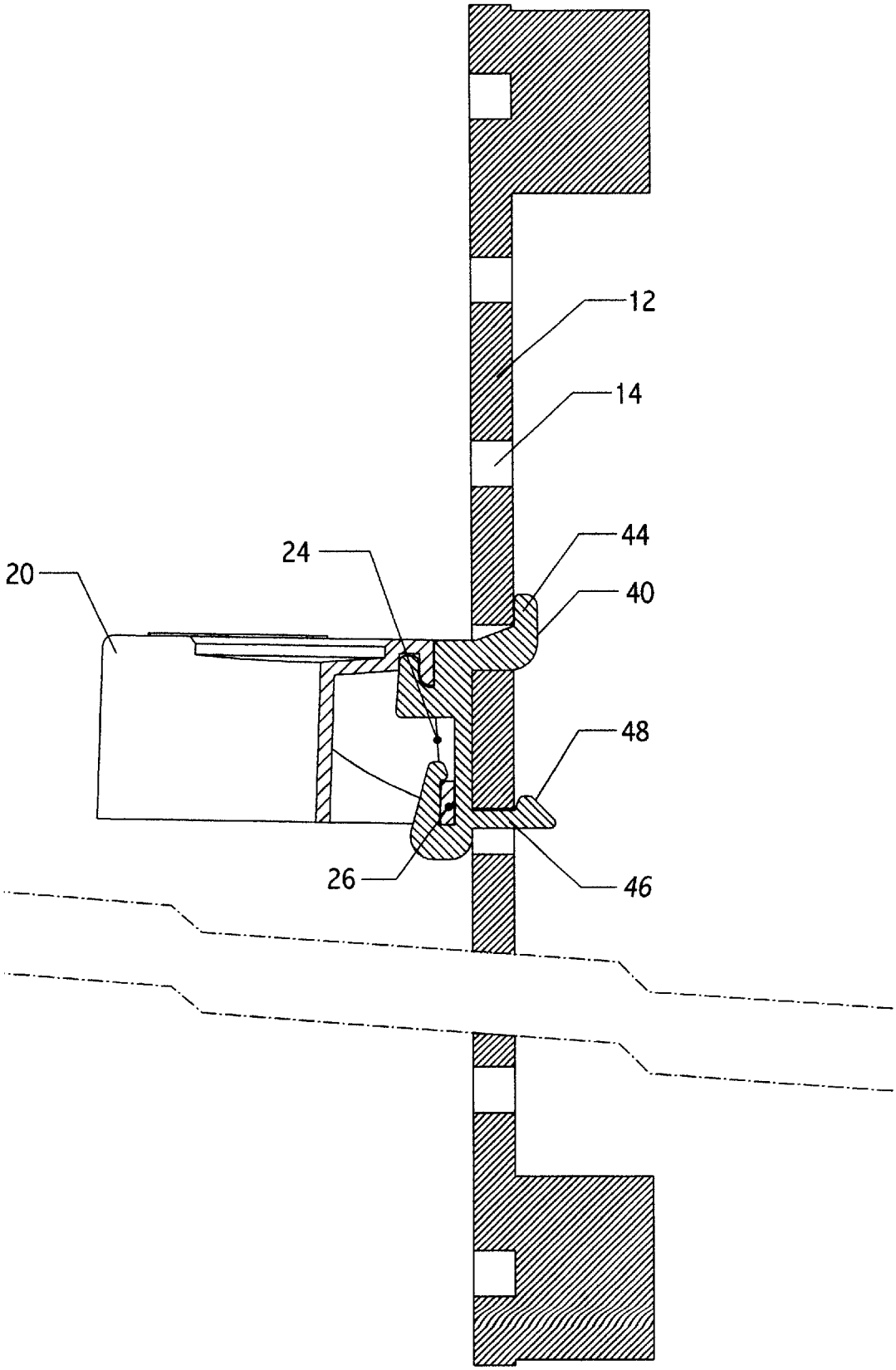
FIG. 10 is a cross sectional view taken along line 10—10 of FIG. 9.
Figure 11:
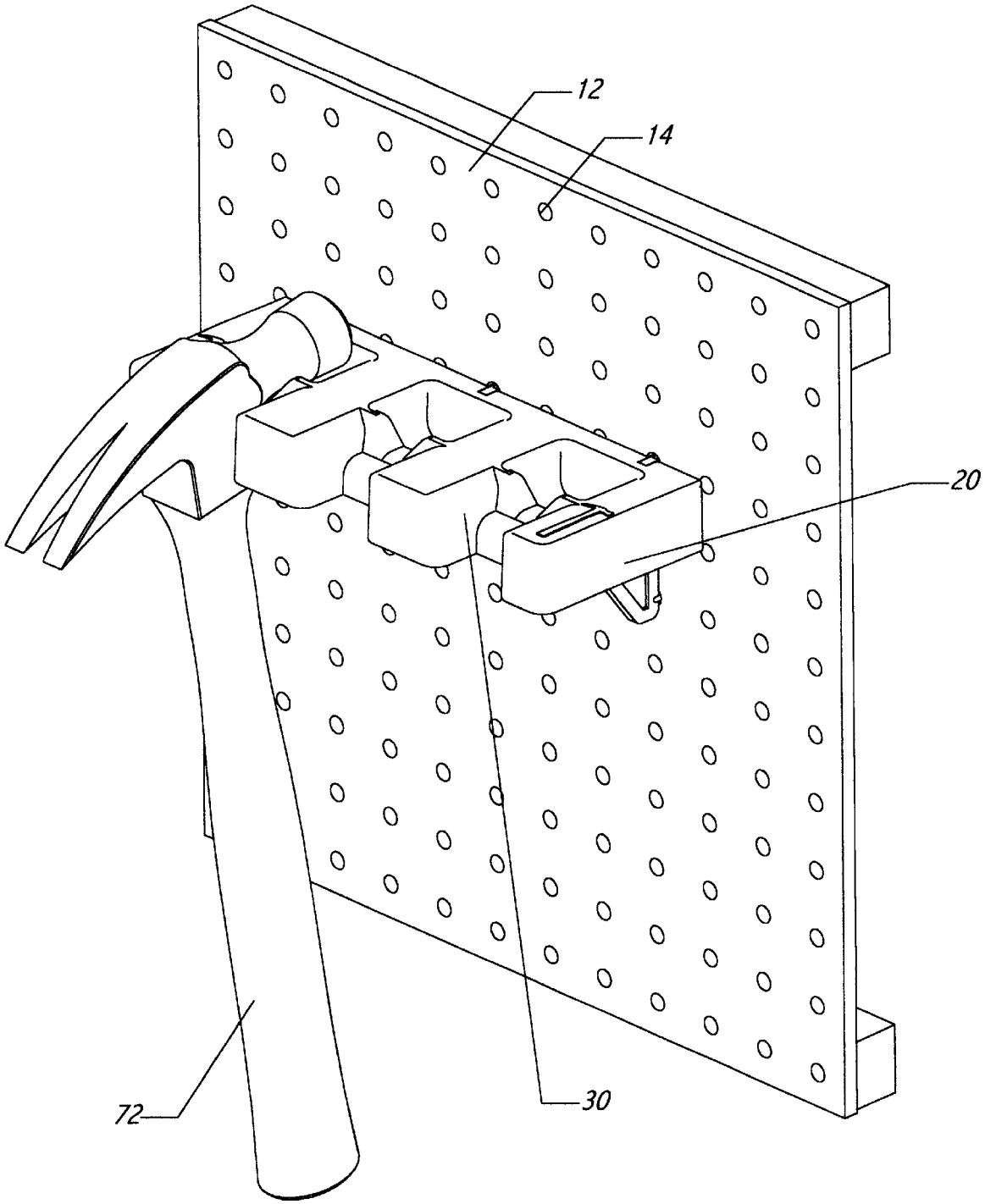
FIG. 11 a front upper perspective view of a first alternative embodiment of the present invention retaining a conventional hammer.
Figure 12:
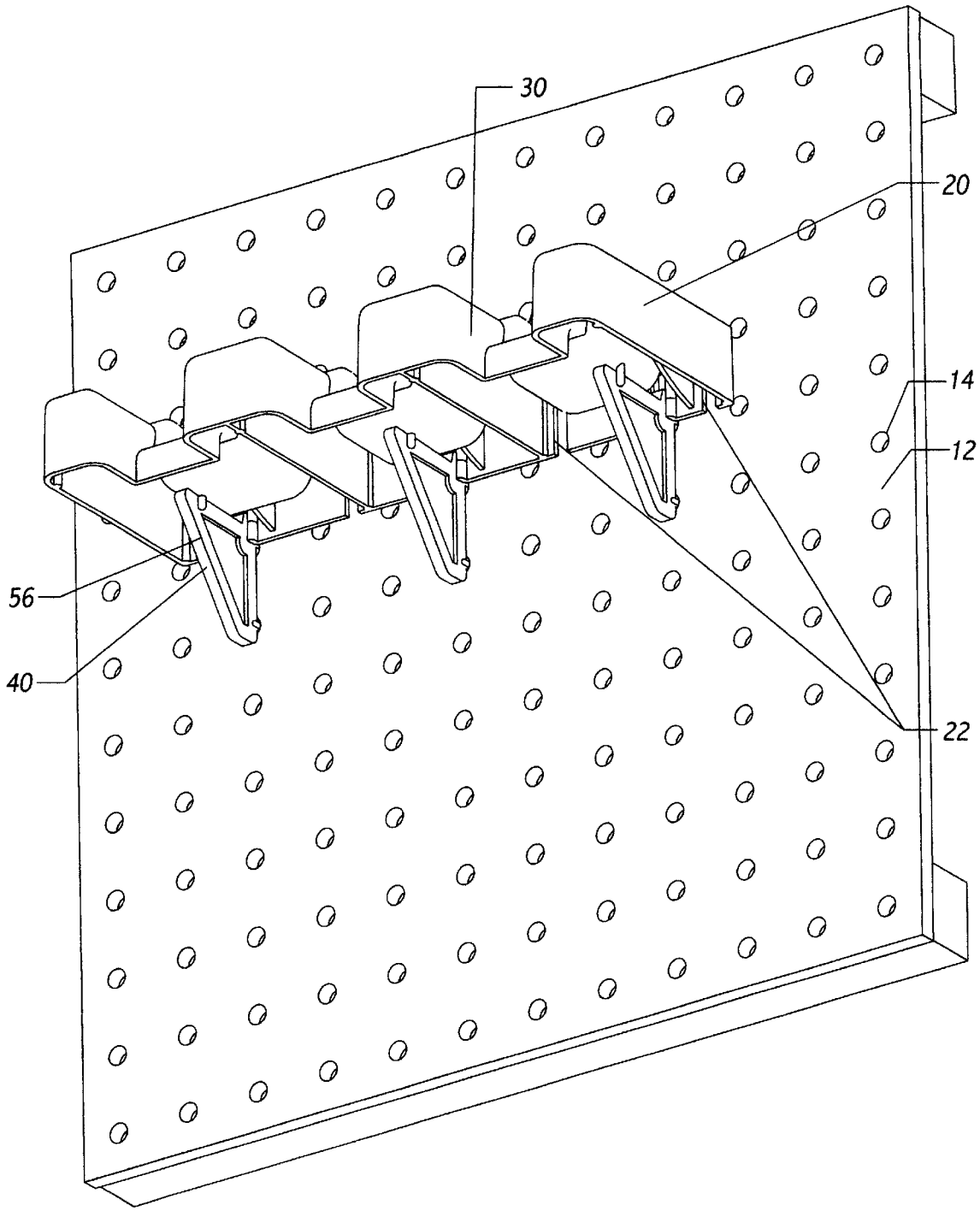
FIG. 12 is a front lower perspective view of the first alternative embodiment of the present invention.
Figure 13:
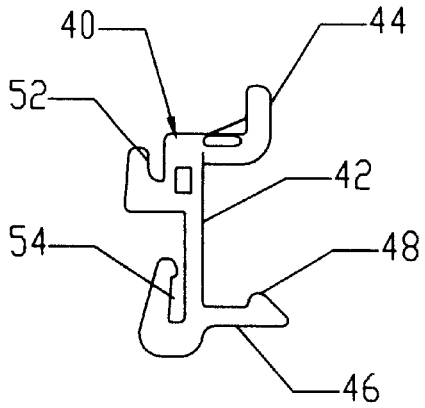
FIG. 13 is a side view of a clip member that secures to the support structure.
Figure 14:
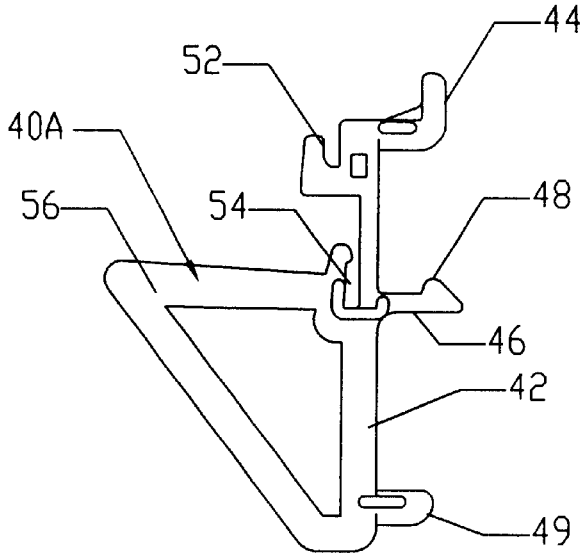
FIG. 14 is a side view of an alternative embodiment of the clip member.
Figure 15:
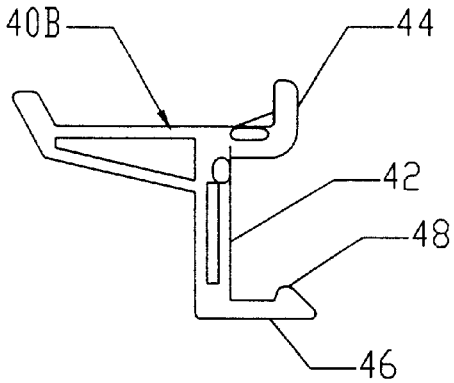
FIG. 15 is a side view of a clip member that is designed for supporting a tool independently from the support structure.

As shown in FIGS. 13, 14 and 15 of the drawings, the clip member 40, 40A, 40B includes a body 42, an upper hook 44 and a lower hook 46. The hooks 44, 46 are formed for securely engaging apertures 14 within a pegboard 12. The upper hook 44 extends from the body 42 substantially horizontal and then bends upwardly substantially orthogonally as best shown in FIGS. 10 and 13. The lower hook 46 preferably includes a lip 48 toward the distal end for catchably engaging the rear perimeter of the apertures 14 within a pegboard 12 as best shown in FIG. 10 of the drawings. The hooks 44, 46 of the clip member 40, 40A are positioned into the apertures 14 of the pegboard 12 wherein the hooks 44, 46 prevent accidental removal especially with the lip 48 engaging the rear perimeter of the apertures 14.

As further shown in FIG. 13 of the drawings, the clip member 40 further includes an upper slot 52 and a lower slot 54 for receiving portions of the support structure 20 within the recessed portions 24. The upper slot 52 extends downwardly from an upper portion of the body 42 thereby forming a hook structure for extending through the aperture within the recessed portions 24 of the support structure 20 and catchably supporting the support structure 20. The lower slot 54 extends downwardly into a lower portion of the body 42 of the clip member 40 thereby forming a hook that catchably engages the lower cross member 26 of the support structure 20.

As shown in FIG. 14, an alternative embodiment of the clip member 40A is provided having a reinforcing portion 56 that extends from the body 42 toward the support structure 20 thereby providing additional support to the support structure 20 during usage with heavy tools such as hammers 72 or the like. In addition, a lower nub 49 may be added to the reinforcing portion 56 below the lower hook 46 to extend into one of the apertures 14 of the pegboard 12 thereby providing additional support to the clip member 40A and the support structure 20.

In use, the user has the option of either attaching each clip member 40 to each of the recessed portions 24 for securing to a pegboard 12, or the user may secure conventional fasteners 18 such as screws into a wall 16 or similar structure for receiving the fastener slots 22 within the rear portion of the support structure 20. If the user desires to attach the support structure 20 to a conventional wall 16, the user simply inserts a plurality of fasteners 18 into the wall 16 that correspond with the fastener slots 22 as shown in FIG. 16 of the drawings. The head portion of the fasteners 18 remains a finite distance from the wall 16 surface thereby allowing the rear portion of the support structure 20 and the fastener slots 22 to snugly fit about the fasteners 18 thereby maintaining the support structure 20 in a substantially orthogonal position with respect to the wall 16. The user is then able to position tools and other devices within the receiver openings 30 within the support structure 20.

If the user desires to secure the support structure 20 to a pegboard 12, the user then inserts the plurality of clip members 40 into the recessed portions 24 of the support structure 20. The user then positions the upper hook 44 of each clip member 40 into one of the apertures 14 within the pegboard 12 with the support structure 20 at an angle with respect to the pegboard 12. The user then lowers the lower portion of the support structure 20 so that the lower hook 46 of each clip member 40 is inserted into and securely engages one of the apertures 14 within the pegboard 12 below the upper hook 44. The user is then able to insert tools and other devices into the receiver opening 30.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A tool holder system, comprising:

a support structure having at least two fastener slots for receiving fasteners and at least one recessed portion that receives at least one clip member;

at least one receiver opening extending into said support structure for receiving at least one tool; and said at least one clip member removably attachable to said support structure, wherein said at least one clip member each includes a body, an upper hook and a lower hook for securing to a pegboard;

wherein said at least one recessed portion includes a center aperture for receiving a portion of said at least one clip member;

wherein said at least one recessed portion includes a lower cross member for receiving a portion of said at least one clip member;

wherein said at least one clip member includes a lower slot for catchably receiving said lower cross member.

2. The tool holder system of claim 1, wherein said at least one clip member includes an upper slot for engaging an upper portion of said support structure above said center aperture.

3. The tool holder system of claim 2, wherein said at least one receiver opening is a slot extending into a front portion of said support structure.

4. The tool holder system of claim 2, wherein said at least one receiver opening is an aperture extending through a top surface and a lower surface of said support structure.

5. The tool holder system of claim 1, wherein said at least one receiver opening is a slot extending into a front portion of said support structure.

6. The tool holder system of claim 1, wherein said at least one receiver opening is an aperture extending through a top surface and a lower surface of said support structure.

7. A tool holder system, comprising:

a support structure having at least two fastener slots for receiving fasteners and at least one receiver opening for receiving at least one tool;

at least one recessed portion extending into a rear portion of said support structure in a vertical manner, wherein said at least one recessed portion includes an aperture; and at least one clip member removably attachable to said support structure within said at least one recessed portion, wherein said at least one clip member includes a body, an upper hook extendable within said aperture, and a lower hook engaging a lower edge of said support structure.

8. The tool holder system of claim 7, wherein said at least one recessed portion includes a lower cross member for receiving a portion of said at least one clip member.

9. The tool holder system of claim 8, wherein said at least one clip member includes a lower slot for catchably receiving said lower cross member.

10. The tool holder system of claim 7, wherein said at least one clip member includes an upper slot for engaging an upper portion of said support structure above said aperture.

11. The tool holder system of claim 7, wherein said at least one receiver opening is a slot extending into a front portion of said support structure.

12. The tool holder system of claim 7, wherein said at least one receiver opening is an aperture extending through a top surface and a lower surface of said support structure.

13. A tool holder system, comprising:

a support structure having at least one receiver opening for receiving at least one tool;

at least one recessed portion extending into a rear portion of said support structure in a vertical manner, wherein said at least one recessed portion includes an aperture; and at least one clip member removably attachable to said support structure within said at least one recessed portion, wherein said at least one clip member includes a body, an upper hook extendable within said aperture, and a lower hook engaging a lower edge of said support structure.

14. The tool holder system of claim 13, wherein said at least one recessed portion includes a lower cross member for receiving a portion of said at least one clip member.

15. The tool holder system of claim 14, wherein said at least one clip member includes a lower slot for catchably receiving said lower cross member.

16. The tool holder system of claim 13, wherein said at least one clip member includes an upper slot for engaging an upper portion of said support structure above said aperture.

17. The tool holder system of claim 13, wherein said at least one receiver opening is a slot extending into a front portion of said support structure.

18. The tool holder system of claim 13, wherein said at least one receiver opening is an aperture extending through a top surface and a lower surface of said support structure.

* * * * *